United States Patent [19]

Wehr

[11] Patent Number: 4,894,283

[45] Date of Patent: Jan. 16, 1990

[54] REUSEABLE THERMAL TRANSFER RIBBON

[75] Inventor: Mary A. Wehr, Hamilton, Ohio

[73] Assignee: NCR Corporation, Dayton, Ohio

[21] Appl. No.: 192,794

[22] Filed: May 10, 1988

[51] Int. Cl.[4] ..... B41M 5/26

[52] U.S. Cl. ..... 428/341; 428/195; 428/342; 428/484; 428/488.1; 428/522; 428/913; 428/914

[58] Field of Search ..... 428/207, 488.1, 484, 428/488.4, 913, 914, 195, 341, 342, 522

[56] References Cited

U.S. PATENT DOCUMENTS

| | | | |
|---|---|---|---|
| 3,037,879 | 6/1962 | Newman et al. | 117/36 |
| 3,892,428 | 7/1975 | Sala et al | 282/28 |
| 3,895,130 | 7/1975 | Barouh et al. | 427/152 |
| 4,321,286 | 3/1982 | Scott et al. | 427/152 |
| 4,337,968 | 7/1982 | Maierson | 282/27.5 |
| 4,427,739 | 1/1984 | Kohle et al. | 428/323 |
| 4,612,243 | 9/1986 | Shimazaki et al. | 428/321 |
| 4,624,881 | 11/1986 | Shini | 428/207 |
| 4,634,629 | 1/1987 | Inaba et al. | 428/343 |
| 4,661,393 | 4/1987 | Uchiyama et al, | 428/200 |
| 4,713,281 | 12/1987 | Shini | 428/207 |

*Primary Examiner*—Pamela R. Schwartz

*Attorney, Agent, or Firm*—Wilbert Hawk, Jr.; Albert L. Sessler, Jr.; George J. Muckenthaler

[57] ABSTRACT

A reusable, thermal transfer ribbon includes a substrate, a functional coating consisting essentially of a carbon black emulsion, a hydrocarbon wax, and a thermoplastic resin, and a binding layer consisting essentially of a thermoplastic resin or a thermoplastic resin and a wax compound.

8 Claims, 1 Drawing Sheet

REUSEABLE THERMAL TRANSFER RIBBON

BACKGROUND OF THE INVENTION

In the printing field, the impact type printer has been the predominant apparatus for providing increased throughput of printed information. The impact printers have included the dot matrix type wherein individual print wires are driven from a home position to a printing position by individual and separate drivers. The impact printers also have included the full character type wherein individual type elements are caused to be driven against a ribbon and paper or like record media adjacent and in contact with a platen.

The typical and well-known arrangement in a printing operation provides for transfer of a portion of the ink from the ribbon to result in a mark or image on the paper. Another arrangement includes the use of carbonless paper wherein the impact from a print wire or a type element causes rupture of encapsulated material for marking the paper. Also known are printing inks which contain magnetic particles wherein certain of the particles are transferred to the record media for encoding characters in manner and fashion so as to be machine readable in a subsequent operation. One of the known encoding systems is MICR (Magnetic Ink Character Recognition) utilizing the manner of operation as just mentioned.

While the impact printing method has dominated the industry, one disadvantage of this type of printing is the noise level which is attained during printing operation. Many efforts have been made to reduce the high noise levels by use of sound absorbing or cushioning materials or by isolating the printing apparatus.

More recently, the advent of thermal printing which effectively and significantly reduces the noise levels has brought about the requirements for heating of extremely precise areas of the record media by use of relatively high currents. The intense heating of the localized areas causes transfer of ink from a ribbon onto the paper or like receiving media. Alternatively, the paper may be of the thermal type which includes materials that are responsive to the generated heat.

The use of thermal printing generally involves a standard thermal transfer ribbon wherein most if not all of the ink is thermally transferred during a single printing operation. Improvements are being made in the reuseable ribbon area to provide for multiple printing operations.

Representative documentation in the area of transfer ribbon printing includes U.S. Pat. No. 3,037,879, issued to D. A. Newman et al. on June 5, 1962, which discloses re-usable, pressure-sensitive, capillary-action, ink-releasing elements including a film foundation of paper or plastic material, a binder layer of plastic material which is at least partly soluble in volatile solvent, and a resinous ink-releasing layer.

U.S. Pat. No. 3,892,428, issued to S. Sala et al. on July 1, 1975, discloses self-regenerative carbographic articles comprising a support layer, a continuous, homogeneous layer essentially consisting of sperm oil and a film forming polymer having good adhesivity, and an inked layer.

U.S. Pat. No. 3,895,130, issued to V. Barouh et al. on July 15, 1975, discloses pressure-sensitive, reusable, imaging material comprising an integral film having a dispersion of pigmented substance in a plasticizer at the bottom of the film and a synthetic polymer in the form of a resinous binder at the top of the film and having a multitude of minute capillary openings serving as a reservoir for the pigmented substance.

U.S. Pat. No. 4,321,286, issued to M. A. Scott et al. on Mar. 23, 1982, discloses pressure-sensitive transfer ribbons of the reusable type having a plastic film foundation with a microporous resinous ink layer bonded thereto and a friction-reducing layer of silicone polymer on the impact surface of the film foundation.

U.S. Pat. No. 4,337,968 issued to T. Maierson on July 6, 1982, discloses a pressure-sensitive record sheet having a spongy, capillary-like film adhered to a paper substrate and the film contains a phenolic resin, amorphous silica, and a fatty alcohol.

U.S. Pat. No. 4,427,739, issued to U. Kohle et al. on Jan. 24, 1984, discloses multiuse pressure-type reproduction or transfer material having a synthetic resin support film with a coating which contains a synthetic resin binder and a coloring agent of an oil base wherein the oil for the base is a polyoxyethylene tenside which forms a plasticizer for the binder.

U.S. Pat. No. 4,612,243, issued to Y. Shimazaki et al. on Sept. 26, 1986, discloses a reusable heat-sensitive transfer recording element which comprises a foundation and an ink-containing layer having porous particles impregnated with a heat-meltable ink and a binder of resinous material that is incompatible with the ink.

U.S. Pat. No. 4,624,881, issued to M. Shini on Nov. 25, 1986, discloses a multiple-use pressure-sensitive recording media which comprises a foundation and a finely porous layer having minute porous particles and a binder material of vinyl chloride-vinyl acetate copolymer for bonding the particles. The porous layer contains a liquid ink paste substantially incompatible with the binder material and the paste has a pigment and an oil-soluble dye.

U.S. Pat. No. 4,634,629, issued to M. Inaba et al. on Jan. 6, 1987, discloses a reusable pressure-sensitive correction element comprising a foundation and an adhesive layer having a resin binder material and a plasticizer capable of plasticizing a polyamide resin which is a main component of the vehicle of a correctable ink.

U.S. Pat. No. 4,661,393, issued to K. Uchiyama et al. on Apr. 28, 1987 discloses an ink composition and an ink sheet which is reusable in a heat transfer recording process. The ink composition contains a solvent dye and a low melting compound containing hydroxyl and/or ethylene oxide and inorganic or organic fine powder.

And, U.S. Pat. No. 4,713,281, issued to M. Shini on Dec. 15, 1987, discloses a multiple-use pressure sensitive transfer recording media which includes a liquid ink paste comprising a pigment, a liquid fatty acid and an oil-soluble dye.

SUMMARY OF THE INVENTION

The present invention relates to nonimpact printing. More particularly, the invention provides a coating formulation or composition and a thermal ribbon or transfer medium for use in imaging or encoding characters, bar codes or other marks on paper or like record media documents which enable machine, or human, or reflectance reading of the imaged or encoded characters. The thermal transfer ribbon enables printing in quiet and efficient manner and makes use of the advantages of thermal printing on documents with a signal inducible ink.

The ribbon comprises a thin, smooth substrate such as tissue-type paper or polyester-type plastic on which is applied a binding layer or coating by well-known or conventional coating techniques. The binding layer bonds substantially equally to the substrate and to a thermal functional coating which provides for and allows the functional coating to have a low binding level. The thermal sensitive layer or coating generally includes a wax mixture dispersed in a binding mix of an ethylene copolymer or a thermoplastic resin to form a wax emulsion. The thermoplastic resin and the solids of the wax emulsion are mixed or dispersed into solution with pigments and/or dyes in an attritor or other conventional dispersing equipment. The thermal functional coating has ingredients that include a pigment, a resin and a binder.

The reuseable thermal transfer ribbon comprises the substrate, the binding layer, and the functional coating and provides that part of the ink layer or thermal-sensitive material of the functional coating is thermally transferred during any one printing operation, thus allowing the same portion or area of the ribbon to be used in a subsequent printing operation.

In view of the above discussion, a principal object of the present invention is to provide a ribbon including a thermal-responsive coating thereon.

Another object of the present invention is to provide a thermal transfer ribbon substrate including a coating thereon for use in imaging or encoding operations.

An additional object of the present invention is to provide a coating on a ribbon substrate having ingredients in the coating which are responsive to heat for transferring a portion of the coating to paper or like record media.

A further object of the present invention is to provide a coating on a ribbon substrate, which coating includes a pigment material and a wax emulsion dispersed in a binder mix and which is responsive to heat for transferring the coating in precise printing manner to paper or like record media.

Still another object of the present invention is to provide a thermally-activated coating on a ribbon that is transferred from the ribbon onto the paper or document in an imaging operation in printing manner for multiple times at precise positions and during the time when the thermal elements are activated to produce a well-defined and precise or sharp image.

Still an additional object of the present invention is to provide a ribbon having a thermal functional layer or coating consisting essentially of a wax emulsion and pigments and which coating is applied over a binding layer for use in repeated or multiple printing operations.

Still a further object of the present invention is to provide a two layered or two coated ribbon which includes a binding layer of resin material and a thermal transfer coating which includes a carbon black emulsion for use in thermal printing wherein a portion of the transfer coating is used during any one printing operation.

Still another object of the present invention is to provide a thermal transfer ribbon which includes a functional coating or layer having high pigment loading and low binding loading which allows splitting of the coating or layer during the printing operation.

Additional advantages and features of the present invention will become apparent and fully understood from a reading of the following description taken together with the annexed drawing.

DESCRIPTION OF THE PREFERRED EMBODIMENT

Figure 1:
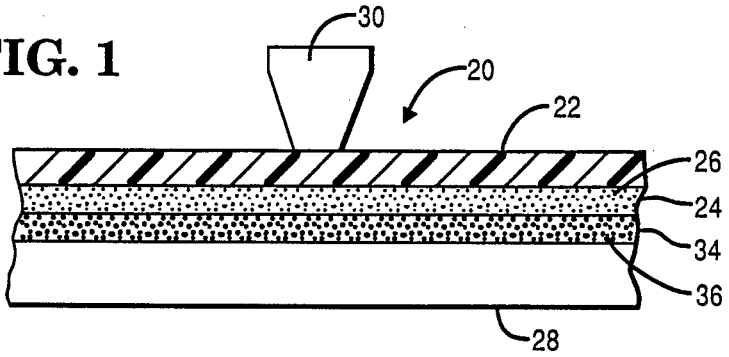
FIG. 1 illustrates a thermal element operating with a ribbon base having a binding layer and a transfer coating thereon incorporating the ingredients as disclosed in the present invention.
Figure 2:
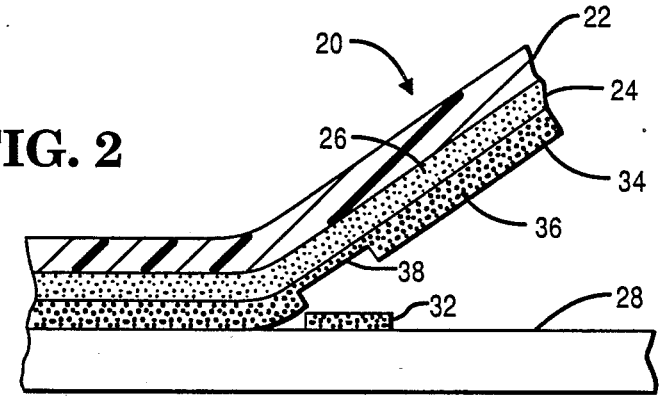
FIG. 2 shows the receiving paper with a part of the thermal functional coating transferred in the form of a character or other mark onto the receiving paper.

The transfer ribbon 20, as illustrated in FIGS. 1 and 2, comprises a base or substrate 22 of thin, smooth, tissue-type paper or polyester-type plastic or like material having a layer or coating 24 which includes a resin-wax composition 26 as an ingredient therein for use in providing a binding layer. A functional coating 34 is thermally activated and includes nonmagnetic pigment or particles 36 as an ingredient therein for use in imaging or encoding operations to enable machine, or human, or reflectance reading of characters or other marks. Each character that is imaged on a receiving paper 28 or like record media produces a unique pattern or image that is recognized and read by the reader. In the case of thermal transfer ribbons relying on the nonmagnetic thermal transfer printing concept, the pigment or particles 36 include coloring materials such as pigments, fillers and dyes.

As alluded to above, it is noted that the use of a thermal printer having a print head element, as 30, substantially reduces noise levels in the printing operation and provides reliability in imaging or encoding of paper or like documents 28. The thermal transfer ribbon 20 provides the advantages of thermal printing while encoding or imaging the document 28 with a nonmagnetic signal inducible ink. When the heating elements 30 of a thermal print head are activated, the imaging or encoding operation requires that the pigment or particles of material 36 in the thermal functional coating 34 on the coated ribbon 20 be transferred from the ribbon to the document 28 in manner and form to produce precisely defined characters 32 for recognition by the reader. In the case of thermal transfer printing, the imaging or encoding material 36 is transferred to the document 28 to produce precisely defined characters or marks 32 for recognition and machine, or human, or reflectance reading thereof. A portion 38 of the thermal functional coating 34 stays with the binding layer 24 and is not transferred to the paper 28 under normal printing conditions. The portion 38 of the coating 34 is then available for transfer and use in a subsequent printing operation.

While each printing operation should provide precisely defined characters or marks 32 on the paper 28, the ribbon 20 involves the use of the intermediate binding layer 24 in cooperation or association with the thermal functional coating 34 to provide a reuseable, thermal sensitive, transfer ribbon. The functional coating 34 essentially consists of high pigment loading which provides a good optical density after transfer of the material 36, an intermediate to high resin loading, and a low binding loading. The low binding loading gives the functional coating 34 a low cohesive level characteristic or parameter. This low cohesion allows the splitting of the functional coating 34 during the printing operation in a manner to effect reuseable or multiple use of such coating. The ribbon 20 provides that part of the ink layer or material 36 in the functional coating 34 is thermally transferred during any one printing operation, thereby allowing the same area of the ribbon to be used in a subsequent printing operation.

The thermal transfer ribbon 20 of the present invention is produced with two layers or coatings wherein the first layer 24 is a binding layer and includes a specific resin and wax emulsion or formulation. The second layer 34 is a functional coating and includes a thermal transfer coating or layer of material.

The following listing of materials provides a general arrangement of the make-ups of the binding layer 24 and of the functional coating 34.

BINDING LAYER

| | |
|---|---|
| Ethylene/Vinyl Acetate Copolymer | 0–100% |
| Ethylene/Vinyl Acetate/Acid Terpolymer | 0–100% |
| Hydrocarbon Resin* | 10–80% |
| Polyethylene | 0–20% |
| Paraffin Wax | 0–30% |
| Additive | 0–20% |

*The listed percent range applies only when hydrocarbon resin is present.
Coating Weight Range 1.5–7.4 grams per square meter.
Preferred Weight 2.3–3.8 grams per square meter.

*The listed percent range applies only when hydrocarbon resin is present.

FUNCTIONAL COATING

| | |
|---|---|
| Coloring Matter (Pigment or Dye such as Carbon Black) | 40–60% |
| Hydrocarbon Wax | 30–50% |
| Ethylene/Vinyl Acetate Copolymer | 2–10% |
| Oleate | 0–5% |

Coating Weight Range 7.4–24.0 grams per square meter.
Preferred Weight 7.5–13.0 grams per square meter.

The following examples provide formulations for the binding layer 24 and for the functional coating 34 of a thermal transfer ribbon 20. These examples are placed into three categories dependent upon the specific contents of the binding layer or coating.

The first category covers those examples wherein the binding layer is essentially 100% thermoplastic resin materials. Resins which are suitable or acceptable and which may be included are ethylene/vinyl acetate copolymer resins, hydrocarbon resins, ethylene/vinyl acetate/acid terpolymers, and polyethylene. Other resins which should be suitable or acceptable include polyvinyl acetate, polyvinyl chloride, vinyl chloride/vinyl acetate copolymer, polypropylene, polyacetal, polystyrene, polyacrylic ester, polyamide, ethyl cellulose, epoxy resin, polyurethane, and synthetic rubbers such as styrene-butadiene rubber or the like.

A second category covers those examples wherein the binding layer comprises a resin material and a wax compound. The resins include those mentioned above in the first category. The wax compounds which are suitable include paraffin wax, carnauba wax, montan wax, microcrystalline wax, and bees wax, or the like. The wax compound improves the handling characteristics of the binding materials.

A third category covers those examples wherein the binding layer contains an additive which is effective for improved slip, is resistant to marring, or is effective as an extender. The additives include pigments such as clays, carbonates, oxides, silicas, stearates or the like.

Examples 1, 2, 4, 5, 6 and 14 are in the first category, Examples 7–12 are in the second category, and Examples 3 and 13 are in the third category.

| | Ex. 1 % | Ex. 2 % | Ex. 3 % | Ex. 4 % | Ex. 5 % |
|---|---|---|---|---|---|
| Binding Layer | | | | | |
| Ethylene/Vinyl Acetate Copolymer | 100 | 100 | 80 | 50 | 25 |
| Silica | | | 20 | | |
| Hydrocarbon Resin | | | | 50 | 75 |
| Ethylene/Vinyl Acetate/Acid Terpolymer | | | | | |
| Paraffin Wax | | | | | |
| Zinc Stearate | | | | | |
| Polyethylene | | | | | |
| Coating Weight (mg/sq. in.) | 2.5 | 1.4 | 1.9 | 4.3 | 3.2 |
| Functional Coat | | | | | |
| Carbon Black Emulsion | 55 | 55 | 55 | 55 | 59 |
| Hydrocarbon Wax | 35 | 35 | 35 | 35 | 39 |
| Ethylene/Vinyl Acetate Copolymer | 10 | 10 | 10 | 10 | 2 |
| Oleate | | | | | |
| Coating Weight (mg/sq. in.) | 8.3 | 6 | 7.8 | 11.8 | 4.8 |

| | Ex. 6 % | Ex. 7 % | Ex. 8 % | Ex. 9 % | Ex. 10 % |
|---|---|---|---|---|---|
| Binding Layer | | | | | |
| Ethylene/Vinyl Acetate Copolymer | | 95 | 90 | 85 | 80 |
| Silica | | | | | |
| Hydrocarbon Resin | | | | | |
| Ethylene/Vinyl Acetate/Acid Terpolymer | 100 | | | | |
| Paraffin Wax | | 5 | 10 | 15 | 20 |
| Zinc Stearate | | | | | |
| Polyethylene | | | | | |
| Coating Weight (mg/sq. in.) | 1.7 | 2 | 2.3 | 1.9 | 1.1 |
| Functional Coat | | | | | |
| Carbon Black Emulsion | 59 | 59 | 59 | 59 | 59 |
| Hydrocarbon Wax | 39 | 39 | 39 | 39 | 39 |
| Ethylene/Vinyl Acetate Copolymer | 2 | 2 | 2 | 2 | 2 |
| Oleate | | | | | |
| Coating Weight (mg/sq. in.) | 8.1 | 6.3 | 5 | 6 | 7.5 |

| | Ex. 11 % | Ex. 12 % | Ex. 13 % | Ex. 14 % |
|---|---|---|---|---|
| Binding Layer | | | | |
| Ethylene/Vinyl Acetate Copolymer | 80 | 80 | 72 | 90 |
| Silica | | | | |
| Hydrocarbon Resin | | | | |
| Ethylene/Vinyl Acetate/Acid Terpolymer | | | | |
| Paraffin Wax | 20 | 20 | 18 | |
| Zinc Stearate | | | 10 | |
| Polyethylene | | | | 10 |
| Coating Weight (mg/sq. in.) | 1.5 | 1.6 | 2 | 4.9 |
| Functional Coat | | | | |
| Carbon Black Emulsion | 59 | 57 | 59 | 59 |
| Hydrocarbon Wax | 39 | 38 | 39 | 39 |
| Ethylene/Vinyl Acetate Copolymer | 2 | 3 | 2 | 2 |
| Oleate | | 2 | | |
| Coating Weight (mg/sq. in.) | 7.5 | 6.8 | 6.3 | 15.5 |

While the coating weight (mg/sq.in.) of both the binding layer and the functional coating are provided in the several examples, it is to be noted that the weight of each ingredient for the binding layer and for the functional coating is a percentage dry weight.

Paraffin 162 wax is a mixture of solid hydrocarbons chiefly of the methane series derived from the paraffin distillate portion of crude petroleum and is soluble in benzene, ligroine, alcohol, chloroform, turpentine, carbon disulfide and olive oil. WB-17 is an oxidized, isocyanated hydrocarbon wax. Elvax 210 is an ethylene vinyl acetate copolymer of high vinyl acetate content that is used as binding material. The hydrocarbon resin is a hard, color stable, substituted styrene copolymer resin and is identified as Piccotex-120.

Silica is silicon dioxide in white tasteless powder form, is insoluble in water and certain acids, and is soluble in molten alkali when finely divided and amorphous. Silica is used as a filler and as a plasticizer. The terpolymer is polymerized from ethylene, vinyl acetate, and acid, is used as a binding material, and is identified as Elvax 4310. Zinc stearate is a white agglutinating powder, soluble in acids and in common solvents when hot, and insoluble in water, alcohol and ether. Zinc stearate is used as a filler, antifoamer, water repellent, a lubricant, or an emulsifier. Polyethylene is a polymerized ethylene and is an important low cost polymer used as an additive.

The carbon black emulsion is a black amorphous powder of relatively coarse particles, insoluble in solvents, is used as a pigment, and is identified as Permablak LS-60. The oleate is used as a filler and also as a coloring agent. Other color dyes or pigments can be mixed into the formulation to provide proper color or toning.

The nonvolatile materials of the functional coating 34 are controlled at 25–55% for proper viscosity. It should be noted that all ingredients are carefully weighed and solubilized in mineral spirits or the like using appropriate heat and agitation. After the solution is complete, it is slowly cooled to form a viscous wax dispersion to prepare a thermally active, transfer coating.

The nonvolatile materials of the binding layer 24 are controlled at or kept within the range of 15–25% for proper viscosity. All ingredients are carefully weighed and solubilized in mineral spirits or the like using appropriate heat and agitation. After the solution is complete, it is slowly cooled to form a viscous dispersion.

The substrate or base 22, which may be 30–40 gauge capacitor tissue, manufactured by Glatz, or 14–35 gauge film as manufactured by E. I. duPont under the trademark Mylar, should have a high tensile strength to provide for ease in handling and coating of the substrate. Additionally, the substrate should have properties of minimum thickness and low heat resistance to prolong the life of the heating elements 30 of the thermal print head by reason of reduced print head actuating voltage and the resultant reduction in burn time.

The binding layer 24 is applied to the substrate 22 by means of conventional coating techniques such as a Meyer rod or like wire-wound doctor bar set up on a typical solvent coating machine to provide a coating weight of between 1 and 5 milligrams per square inch (1.5–7.4 grams per square meter). A preferred weight of the binding layer 24 is about 2 milligrams per square inch (3.6 grams per square meter). The thermal functional coating 34 is applied at a weight of between 4.8 and 15.5 milligrams per square inch (7.4–24.0 grams per square meter). A preferred weight of the functional coating 34 is about 7.5 milligrams per square inch (11.6 grams per square meter).

The coating 34 is made up of approximately 25–55% nonvolatile material and is maintained at a desired temperature and viscosity throughout the coating process. A temperature of approximately 40° –45° C. is maintained during the entire coating process. After the binding layer 24 is applied to the substrate 22 and the thermal functional coating 34 is applied to the layer 24, the web of ribbon 20 is passed through a dryer at an elevated temperature in the range between 80° C. and 120° C. for approximately 5–10 seconds to ensure good drying and adherence of the binding layer 24 onto the substrate 22 and of the thermal functional coating 34 on the layer 24 in making the transfer ribbon 20. The above-mentioned coating weight, as applied by the Meyer rod onto a preferred 4–10 microns thick substrate 22, overall translates to a total thickness of 7–15 microns. The portion 38 and subsequent portions of the area of the thermal functional coating 34 can be transferred onto the receiving substrate 28 in the range of 50° C. –120° C. by changing the ranges of the waxes used in the functional coating 34.

The availability of the various ingredients used in the present invention is provided by the following list of companies.

| Material | Supplier |
|---|---|
| Ethylene/Vinyl Acetate Copolymer | E. I. duPont |
| Silica | Davison |
| Hydrocarbon Resin | Hercules Inc. |
| Ethylene/Vinyl Acetate/Acid Terpolymer | E. I. duPont |
| Paraffin Wax | Boler |
| Zinc Stearate | Witco Chemical |
| Polyethylene | Bareco |
| Carbon Black Emulsion | Mono-Chem |
| Mineral Spirits | Ashland Chemical Co. |
| Hydrocarbon Wax | Bareco |
| Oleate | BASF |

It is thus seen that herein shown and described is a thermal transfer ribbon for use in thermal printing operations which includes a binding layer or coating and a thermal-responsive functional coating. The coated ribbon enables repeated transfer of coating material onto documents or like record media during the printing operations to form characters or other marks on the media in an imaging or in an encoding nature, permitting machine or other reading of the characters or marks. The present invention enables the accomplishment of the objects and advantages mentioned above, and while a preferred embodiment has been disclosed herein, variations thereof may occur to those skilled in the art. It is contemplated that all such variations and any modifications not departing from the spirit and scope of the invention hereof are to be construed in accordance with the following claims.

What is claimed is:

1. A reuseable, thermal sensitive transfer element comprising a substrate, a functional coating containing as essential ingredients about 55% carbon black, about 35% hydrocarbon wax, and about 10% ethylene vinyl acetate copolymer, all by dry weight, and a binding layer positioned between and binding said substrate and said functional coating and containing 100% ethylene vinyl acetate copolymer, by dry weight.

2. The transfer element of claim 1 wherein the functional Coating weight is about 6 to 8 milligrams per square inch.

3. The transfer element of claim 1 wherein the binding layer weight is about 1.5 to 2.5 milligrams per square inch.

4. A reuseable, thermal sensitive transfer element comprising a substrate, a functional coating containing as essential ingredients about 59% carbon black, about 39% hydrocarbon wax, and about 2% ethylene vinyl acetate copolymer, all by dry weight, and a binding layer positioned between and binding said substrate and said functional coating and containing as essential ingredients about 95% ethylene vinyl acetate copolymer and about 5% paraffin wax, by dry weight.

5. A reuseable, thermal sensitive transfer element comprising a substrate, a functional coating containing as essential ingredients about 59% carbon black, about 39% hydrocarbon wax, and about 2% ethylene vinyl acetate copolymer, all by dry weight, and a binding layer positioned between and binding said substrate and said functional coating and containing as essential ingredients about 90% ethylene vinyl acetate copolymer and about 10% paraffin wax, by dry weight.

6. A reuseable, thermal sensitive transfer element comprising a substrate, a functional coating containing as essential ingredients about 59% carbon black, about 39% hydrocarbon wax, and about 2% ethylene vinyl acetate copolymer, all by dry weight, and a binding layer positioned between and binding said substrate and said functional coating and containing as essential ingredients about 85% ethylene vinyl acetate copolymer and about 15% paraffin wax, by dry weight.

7. A reuseable, thermal sensitive transfer element comprising a substrate, a functional coating containing as essential ingredients about 59% carbon black, about 39% hydrocarbon wax, and about 2% ethylene vinyl acetate copolymer, all by dry weight, and a binding layer positioned between and binding said substrate and said functional coating and containing as essential ingredients about 80% ethylene vinyl acetate copolymer and about 20% paraffin wax, by dry weight.

8. A reuseable, thermal sensitive transfer element comprising a substrate, a functional coating containing as essential ingredients about 57% carbon black, about 38% hydrocarbon wax, about 3% ethylene vinyl acetate copolymer, and about 2% oleate, all by dry weight, and a binding layer positioned between and binding said substrate and said functional coating and containing as essential ingredients about 80% ethylene vinyl acetate copolymer and about 20% paraffin wax, by dry weight.

* * * * *